US005145118A

United States Patent [19]

Canada

[11] Patent Number: 5,145,118

[45] Date of Patent: Sep. 8, 1992

[54] CENTRIFUGAL IMPACTOR FOR CRUSHING ROCKS

[76] Inventor: Larry D. Canada, P.O. Box 326, Cascade, Mont. 59421

[21] Appl. No.: 786,458

[22] Filed: Nov. 1, 1991

Related U.S. Application Data

[63] Continuation-in-part of Ser. No. 698,496, Apr. 23, 1991, abandoned, and Ser. No. 684,462, Apr. 9, 1991, abandoned, which is a continuation-in-part of Ser. No. 574,122, Aug. 29, 1990, abandoned.

[51] Int. Cl.[5] ..... B02C 23/00

[52] U.S. Cl. ..... 241/81; 241/275

[58] Field of Search ..... 241/81, 275

[56] References Cited

U.S. PATENT DOCUMENTS

| | | | |
|---|---|---|---|
| 2,012,694 | 8/1935 | Runyan . | |
| 2,468,321 | 4/1949 | Bland . | |
| 2,992,784 | 7/1961 | Behnke et al. | 241/275 |
| 3,074,435 | 12/1991 | Suverkrop et al. | 241/81 X |
| 3,346,203 | 10/1967 | Danyluke . | |
| 3,622,089 | 11/1971 | Quinn . | |
| 3,834,631 | 9/1974 | King . | |
| 3,860,184 | 1/1975 | Acton | 241/275 |
| 3,970,257 | 7/1976 | MacDonald et al. . | |
| 4,515,316 | 5/1985 | Kawaguchi . | |
| 4,575,013 | 3/1986 | Bartley . | |
| 4,662,571 | 5/1987 | MacDonald et al. . | |
| 4,844,354 | 7/1989 | Watajima . | |
| 4,921,173 | 5/1990 | Bartley . | |
| 4,940,188 | 7/1990 | Rodriguez et al. . | |

FOREIGN PATENT DOCUMENTS

| | | | |
|---|---|---|---|
| 372149 | 6/1990 | European Pat. Off. | 241/275 |
| 2588487 | 4/1987 | France | 241/275 |
| 376760 | 7/1932 | United Kingdom . | |

*Primary Examiner*—Mark Rosenbaum
*Assistant Examiner*—Frances Chen
*Attorney, Agent, or Firm*—John R. Flanagan

[57] ABSTRACT

An improved centrifugal impactor for crushing rocks includes a hollow housing having a peripheral crushing chamber and a rotor mounted in the housing for rotation relative thereto about a generally vertical axis and spaced radially inwardly from the crushing chamber so as to define an annular passage for communicating a flow of rocks from an upper inlet opening and the crushing chamber to a lower outlet opening. The rotor includes a horizontal platform and a pair of outer and inner annular vertical barrier members attached to and extending upwardly from the horizontal platform. The outer barrier member is disposed about a peripheral edge of the horizontal platform. The inner barrier member is disposed in concentric relation with the outer barrier member and spaced radially inwardly from the outer barrier member and outwardly from the vertical rotational axis of the rotor and extends a shorter distance above the horizontal platform than does the outer barrier member such that the outer and inner barrier members of the rotor cooperate to trap and accumulate rocks and form a pair of separate concentric annular beds of accumulated rocks in a substantially symmetrical distribution on the horizontal platform of the rotor which rotate with the rotor and produce an improved internal balance of a rotor and a substantially uniform centrifugal discharge of rocks from the rotor over the inner and outer walls thereof.

20 Claims, 3 Drawing Sheets

CENTRIFUGAL IMPACTOR FOR CRUSHING ROCKS

CROSS-REFERENCE TO RELATED APPLICATIONS

This application is a continuation-in-part of U.S. patent application Ser. No. 698,496 filed Apr. 23, 1991, and of U.S. patent application Ser. No. 684,462 filed Apr. 9, 1991 which, in turn, is a continuation-in-part of U.S. patent application Ser. No. 574,122 filed Aug. 29, 1990 all abandoned.

BACKGROUND OF THE INVENTION

1. Field of the Invention

The present invention generally relates to impact breaking and crushing of rock and, more particularly, is concerned with a improved centrifugal impactor for crushing rocks. The term "rocks" as used herein is meant to include a wide variety of solid materials.

2. Description of the Prior Art

Centrifugal impactors, such as disclosed in U.S. Pat. Nos. 3,970,257 and 4,662,571 to MacDonald et al, have provided the rock crushing industry with mechanisms for producing small rock particles. The mode of operation of these centrifugal impactors is as follows. Incoming rocks are fed into a rotor from above through a feed eye ring, near a vertical rotational axis of the rotor. The incoming rocks are engaged and impelled outwardly under centrifugal force by a plurality of circumferentially arranged and spaced vanes of the rotating rotor. A vane tip is located at the radially most distant point on each vane along the path of a rock's movement in the rotor relative to the vane. Rocks moving in the rotor exit past the tips of the vanes through discharge openings between the vanes and are then broken either by impact with other rocks or upon impact with some part of the centrifugal impactor itself appropriately positioned radially outwardly from the rotor.

On the rotor, the feed eye ring is comprised of a wear resistant replaceable part which protects the rotor entry opening from excess abrasion. The tips of the vanes are readily abraded by the stream of impelled rocks being discharged past the vane tips. In the past, attempts to reduce tip wear have relied primarily upon capturing a layer of rock in the vanes on the rotor to reduce the wear to the vanes and also in making the extremity of each vane tip, called a "tip carrier", of wear resistant material.

Examples of tip carriers using a fixed wear-resistant material are disclosed in U.S. Pat. No. 3,346,203 to Danyluke and U.S. Pat. No. 4,940,188 to Rodriguez et al. In these devices, a layer of rock builds up in front of the vane and inside the tip to protect most of the vane from continual wear. Rocks leaving the vane still have to pass around the tip carrier which is fixedly connected to the vane. The relative velocity and angle of trajectory between the moving rocks and the tip carrier fixed to the vane largely determines the degree of abrading action taking place at the tip carrier. The wear-resistant material used in the tip carriers is brittle and can be broken and destroyed by impact with the centrifugally moving rock.

Many conventional rotors also have outer wear-bits to protect the sides of the rotor housing. These wear-bits are located outside and behind the tip and are positioned to deflect rocks that are rebounding in such a way as to strike the outer wall of the vane. These bits are regularly broken by the impact force of rebounding rock.

To further protect the rotor by reducing the size of the rocks being fed into the rotor, separating and bypassing devices have also been developed. An example is the screen disclosed in the aforementioned U.S. Pat. No. 4,662,571 to MacDonald et al being formed by a conically-arranged series of concentric rings. The problems with a cone type screen of the MacDonald et al patent are the increasing radius which varies opening size, the resultant low screening area, and the increase in overall height of the machine added by this type of screen.

A different centrifugal impactor disclosed in U.S. Pat. No. 3,834,631 to King employs a symmetrical bowl-shaped rotor without any a feed eye ring nor a plurality of vanes with vane tips. The principle of operation of this centrifugal impactor is as follows. Rocks are fed from above into the rotating bowl-shaped rotor. Some rocks are thrown against the interior surface of the bowl sidewall and held in place by centrifugal force. As more rocks are fed into the bowl-shaped rotor the rock lining is supposed to build up to an equilibrium shape in the form of a paraboloid-like surface with its open end toward the upper open end of the rotating bowl-shaped rotor. Thereafter rocks are discharged from the rotor as fast as they enter.

Since there are no vanes in the rotor of this centrifugal impactor, the rocks are acted upon and caused to rotate or spin on their own axes as they are discharged from the rotor largely due to the force of friction produced by contact with the rotating rotor and the rock lining therein which rotates with the rotor. The net effect of the spinning action of the rocks and their impact with the lining of rocks in a trap chamber of the impactor which surrounds the rotor is that they break apart into smaller fragments.

However, a major problem with the rotor of the King centrifugal impactor is vibration due to unequal loading of the rotor sidewall. In most instances, the lining of bowl-shaped rotor with rocks will not be symmetrical. Oftentimes, a larger piece of rock will lodge against the interior of the rotor sidewall and act as a dam, holding even more rocks. The lining of the rotor will then become two or three inches thicker on one side than the other. In time, new entering rocks will grind this condition away, only to have it reoccur. The persist occurrence of a non-symmetrical lining will throw the rotor out of balance, requiring shutdown of the machine due to excessive vibration.

From the above description of the various problems associated with prior art centrifugal impactors, it can be seen that need exists for improvements to alleviate these problems without introducing new ones in their place.

SUMMARY OF THE INVENTION

The present invention provides an improved centrifugal impactor for crushing rocks being designed to satisfy the aforementioned need. The improvements incorporated by the centrifugal impactor of the present invention eliminate the need to use conical screens, feed eye rings, tip carriers and outer wear bits as found in the prior art MacDonald et al centrifugal impactor, and also eliminate the non-symmetrical vibration-inducing loading of the rotor as occurs in the King centrifugal impactor. The improved centrifugal impactor of the present invention will receive rocks of larger sizes and produce higher throughput with less consumption of horsepower and reduced wear costs.

Accordingly, the present invention is directed to a centrifugal impactor for crushing rocks. The impactor comprises: (a) a hollow housing defining a peripheral annular crushing chamber for receiving and holding rocks and a central cavity encompassed by the crushing chamber; and (b) a rotor mounted within the central cavity of the housing for rotation relative thereto about a generally vertical axis.

The housing has an upper inlet opening located above the crushing chamber and above the central cavity for entry of rocks into the housing. The housing also has a lower outlet opening located below the crushing chamber and below the central cavity for discharge of rocks from the housing. The rotor is spaced radially inwardly from the crushing chamber of the housing so as to define an annular passage between the crushing chamber and rotor for communicating a flow of rocks from the upper housing inlet opening and the crushing chamber to the lower housing outlet opening.

The rotor includes a horizontal platform and a pair of outer and inner annular barrier members. The outer barrier member is disposed about a peripheral edge of the horizontal platform. The inner barrier member is disposed in concentric relation with the outer barrier member about the rotational axis of the rotor and has a peripheral edge spaced radially inwardly from the outer barrier member and outwardly from the rotational axis. The inner barrier member extends a shorter distance above the horizontal platform than does the outer barrier member. Given such relative positional arrangement and sizes, the outer and inner barrier members of the rotor cooperate to trap and accumulate rocks and form a pair of separate annular beds of accumulated rocks in a substantially symmetrical distribution on the horizontal platform of the rotor which rotate with the rotor and produce an improved internal balance of a rotor and a substantially uniform centrifugal discharge of rocks from the rotor over the inner and outer barrier members over the annular passage and toward the crushing chamber.

Preferably, the outer and inner annular barrier members are cylindrical in shape and are attached to and extend upwardly from the horizontal platform. In a modified form, the inner annular barrier member is a planar ring attached at an outer peripheral edge to the outer barrier member and extending radially inwardly therefrom in a cantilevered fashion.

The present invention also provides a separation and bypass arrangement in the centrifugal impactor which includes a separator and a hopper. The separator is disposed in stationary position above the upper inlet opening of the housing and is adapted to receive an incoming flow of rocks and separate the rocks into a first stream of rocks larger than a grade-size defined by the separator and a second stream of rocks smaller than grade-size. The hopper has an upper portion mounted to the housing and extending above and about the upper inlet opening thereof, and a lower portion mounted to the upper portion and extending downwardly through the upper inlet opening of the housing. The upper and lower portions of the hopper support the separator. The upper portion of the hopper is adapted to guide the first stream of larger than grade-size rocks from the separator toward the crushing chamber. The lower portion of the hopper is adapted to guide the second stream of smaller than grade-size rocks from the separator toward the rotor.

The present invention further provides an annular wear collar in the centrifugal impactor. The annular wear collar is supported by the housing in a stationary position in the annular passage between the rotor and the crushing chamber and adjacent to and around the outer vertical barrier member of the rotor to shield the outer vertical barrier member from impacts by rocks passing through the passage.

The present invention still further provides an annular cover in the centrifugal impactor being adjustably support above the crushing chamber for vertical movement toward and away from the crushing chamber. Such movement of the annular cover will vary the size of the crushing chamber and thus vary the period of time rocks can remain in the crushing chamber and thereby vary the gradation of rocks crushed in the impactor.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE PREFERRED EMBODIMENT

Figure 1:
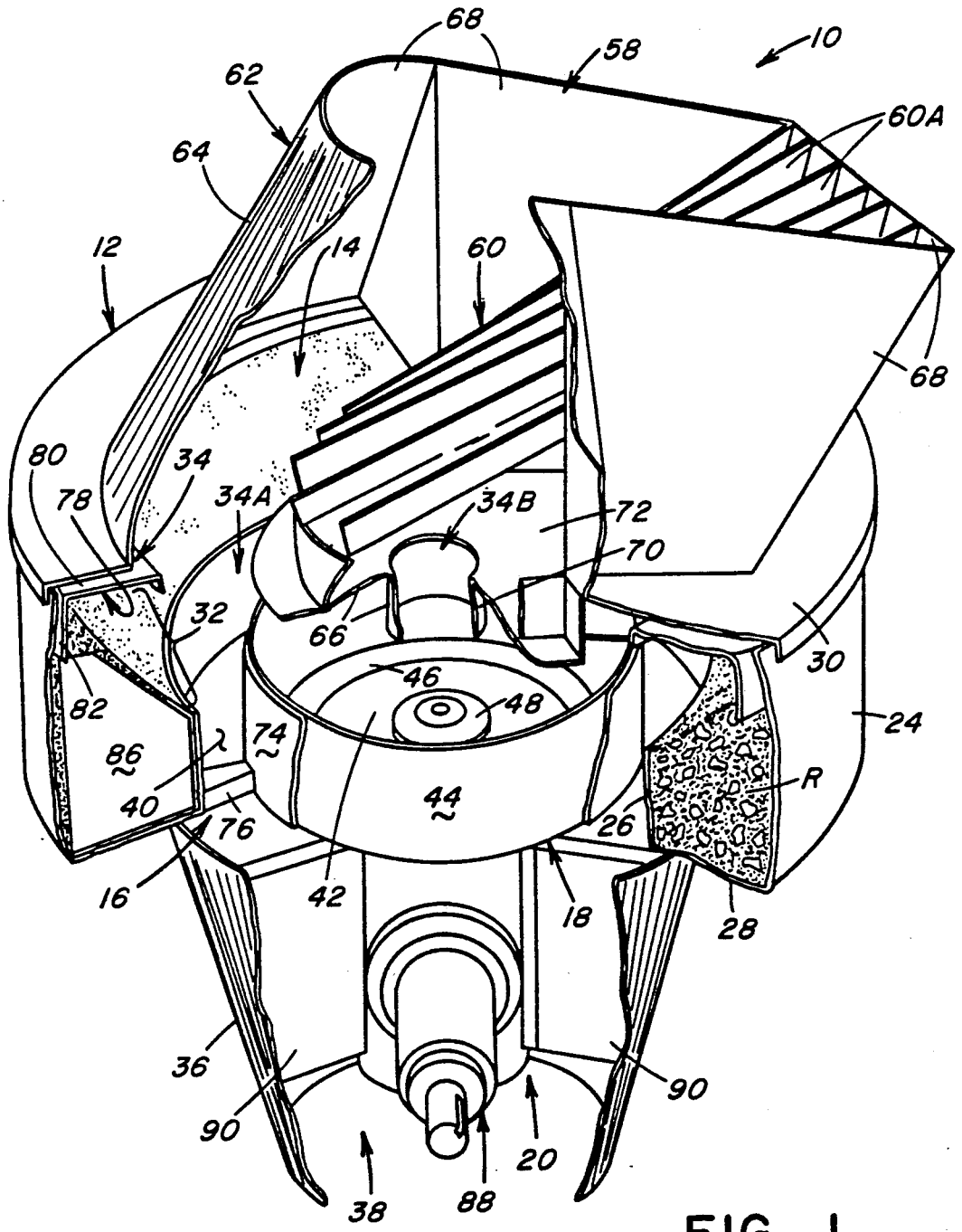
FIG. 1 is a perspective view, with portions broken away, of an improved centrifugal impactor of the present invention.
Figure 2:
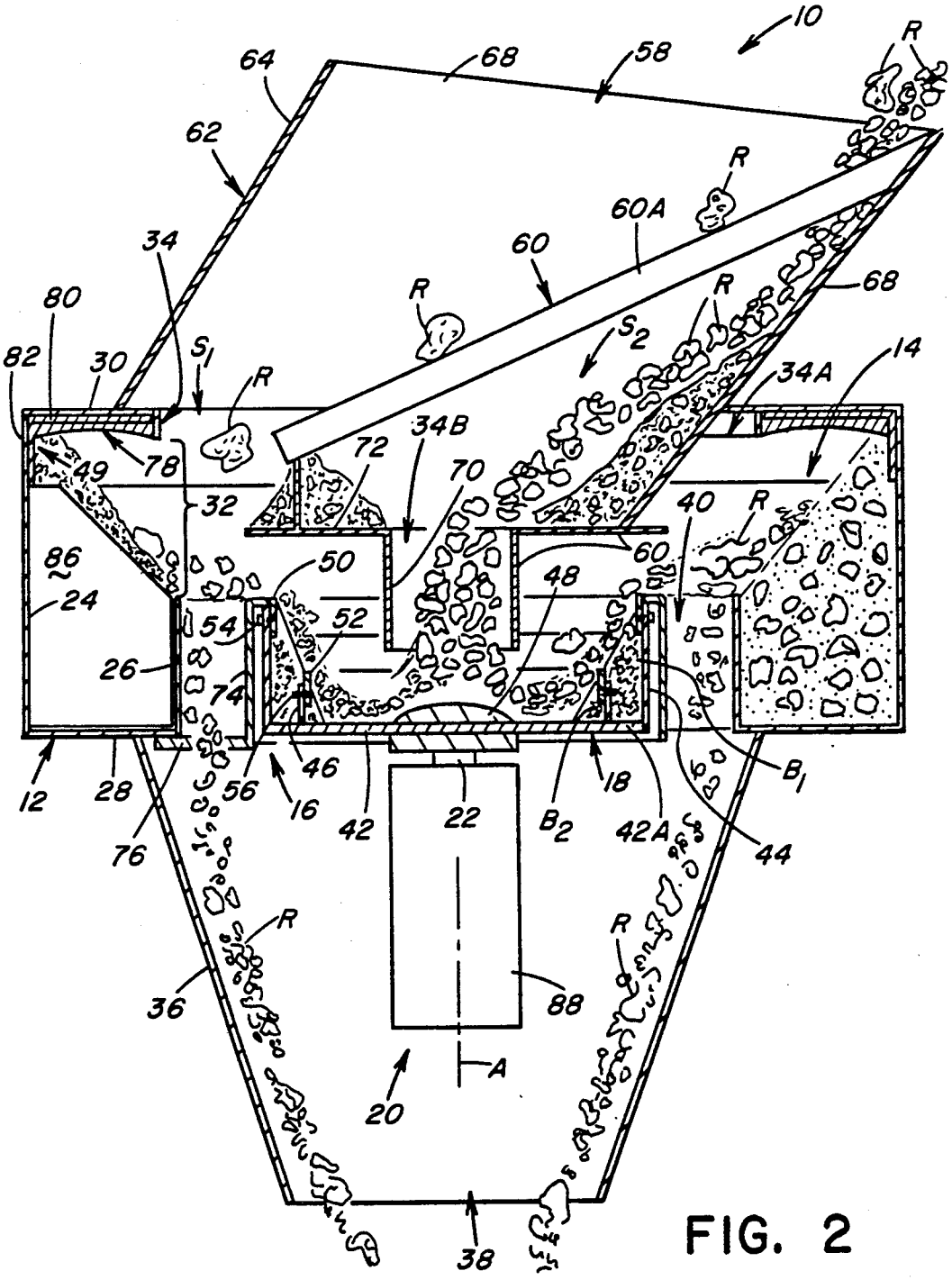
FIG. 2 is a vertical axial sectional view of the centrifugal impactor of FIG. 1.

Referring to the drawings, and particularly to FIGS. 1 and 2, there is illustrated a preferred embodiment of a centrifugal impactor for crushing rocks, being generally designated by the numeral 10 and incorporating the improvements of the present invention. Basically, the centrifugal impactor 10 includes a hollow housing 12 having a peripheral annular dead-bed crushing chamber 14 for receiving and holding rocks R and a central cavity 16 encompassed by the crushing chamber 14, a rotor 18 for receiving rocks R and centrifugally impelling them outwardly toward the peripheral crushing chamber 14 for collision with rocks therein, and a drive means 20 mounted to the housing 12 below the rotor 12 and including a generally vertical drive shaft 22 supporting the rotor 18 within the central cavity 16 of the housing 12 for rotation relative to the housing 12 about a generally vertical axis A of the impactor 10 defined by the drive shaft 22.

More particularly, the hollow housing 12 of the impactor 10 includes a pair of outer and inner annular vertical walls 24, 26 and a pair of lower and upper annular horizontal wall 28, 30 which together to define the peripheral annular dead-bed crushing chamber 14 in the housing 12. The inner annular vertical wall 26 is disposed concentric with and spaced radially inwardly from the outer annular vertical wall 24 relative to the vertical axis A, and is shorter in height than the outer annular vertical wall 28. The lower annular horizontal wall 28 extends between and connected to the outer and inner annular vertical walls 24. 26. The upper annular horizontal wall 30 is connected to the outer annular vertical wall 26 and extend radially inwardly therefrom and together with the inner annular vertical wall 26 defining an annular opening 32 to the peripheral crushing chamber 14 through which rocks R can enter into and exit from the crushing chamber 14.

The upper annular horizontal wall 30 of the housing 12 also defines an upper inlet opening 34 in the housing 12 for entry of rocks R into the housing 12. The lower annular horizontal wall 28 of the housing 12 and a lower conical skirt 36 attached to and extending downwardly from the lower wall 28 together define a lower outlet opening 38 for discharge of rocks R from the housing 12. Thus, the upper inlet opening 34 is located above the crushing chamber 14 and the central cavity 16 for entry of rocks R into the housing 12, while the lower outlet opening 38 is located below the crushing chamber 14 and the central cavity 16 for discharge of rocks R from the housing 12.

Figure 3:
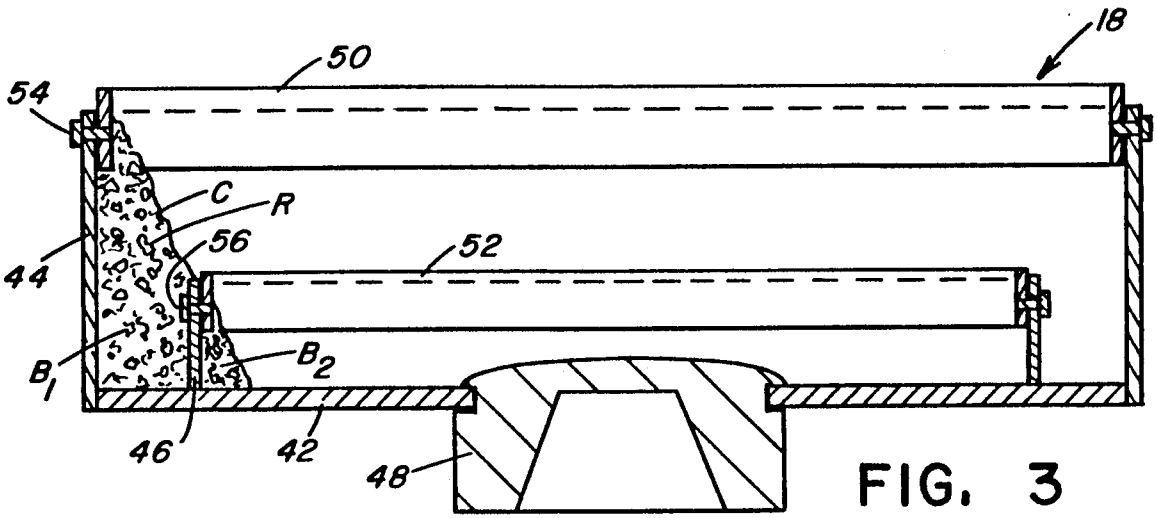
FIG. 3 is an enlarged view of a rotor of the centrifugal impactor as shown in FIG. 2.

Referring to FIGS. 1–3, the rotor 18 of the impactor 10 is spaced radially inwardly from the crushing chamber 14 of the housing 12 so as to define an annular passage 40 between the crushing chamber 14 and rotor 18 for communicating a flow of rocks R from the upper housing inlet opening 34 and the crushing chamber opening 32 to the lower housing outlet opening 38. More particular, the rotor 18 includes a horizontal circular platform 42 and a pair of outer and inner vertical annular barrier wall members 44, 46. The vertical barrier members 44, 46 are cylindrical-shaped and are attached to and extend upwardly from the horizontal platform 42. The horizontal platform 42 is attached by a coupling 48 upon an upper end of the drive shaft 22. The upper side of the coupling 48 extending above the horizontal platform 42 has a rounded shape which promotes shedding of the rocks R therefrom upon rotation of the rotor 18.

The outer vertical barrier member 44 is disposed about a peripheral edge 42A of the horizontal platform 42. The inner vertical barrier member 46 is disposed in concentric relation with the outer vertical barrier member 44 about the rotational axis A of the rotor 18 and spaced radially inwardly from the outer vertical barrier member 44 and outwardly from the rotational axis A. The inner vertical barrier member 46 extends a shorter distance above the horizontal platform 42 than does the outer vertical barrier member 44. The horizontal platform 42 and outer and inner barrier members 44, 46 of the rotor 18 can be separate components which are assembled together, such as by welding, or parts of an integral cast one-piece structure.

Given such relative positional arrangement and sizes, the outer and inner vertical barrier members 44, 46 of the rotor 18 cooperate to trap and accumulate rocks R and form a pair of separate annular beds $B_1$, $B_2$ of the accumulated rocks having a substantially symmetrical distribution on the horizontal platform 42 of the rotor 18 which will rotate with the rotor 18. The symmetrical distribution of the rocks R in the beds thereof produces an improved internal balance of the rotor 18 which reduces vibration of the impactor 10 and provides a substantially uniform centrifugal discharge of rocks R from the rotor 18 over the upper edges of the inner and outer vertical barrier members 46, 44 thereof.

As best seen in FIG. 2, the pair of separate annular beds $B_1$, $B_2$ of the accumulated rocks R trapped by the outer and inner vertical barrier members 44, 46 define a radially upwardly and outwardly inclined surface C which defines the path along which rocks R are centrifugally impelled from the rotating rotor 18. The centrifugally impelled rocks tend to rotate about their own axes as they pass over the beds $B_1$, $B_2$ and over the upper edges of the barrier members 44, 46 and to grind away some of the rocks retained in the beds. Respective replaceable wear rings 50, 52 are preferably attached by fasteners 54, 56 at the inside of the upper edges of the outer and inner vertical barrier members 44, 46 to protect them from contact with rocks passing over the barrier members 44, 46. The wear ring 52 on the inner barrier member 46 extends above the surface C so as to provide a break between the two beds. After a period of use, the wear rings 50, 52 may be removed and inverted allowing for double the wear from each ring. Alternatively, the upper edges of the outer and inner vertical barrier members 44, 46 can be hard-surfaced to protect them from wear.

Figure 6:
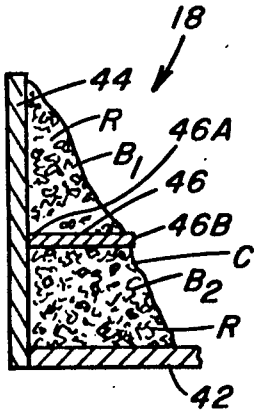
FIG. 6 is a fragmentary view of the rotor of FIG. 3, illustrating an alternative arrangement of a pair of outer and inner annular barrier members of the rotor.

Referring to FIG. 6, there is shown an alternative arrangement of the outer and inner barrier members 44, 46 of the rotor 18. The outer barrier member 44 is the same as in the preferred embodiment of FIGS. 1 and 2. However, the inner barrier member 46 now is in the form of an annular substantially planar ring attached at its outer peripheral edge 46A to the outer barrier member in a location spaced above the horizontal platform 42. The inner barrier member 46 extends horizontally in cantilevered fashion from the outer vertical barrier member 44 in substantially parallel relation to the horizontal platform 42 to an inner terminal peripheral edge 46B. The rocks R are now trapped and accumulate into annular beds $B_1$, $B_2$ located respectively above and below the inner barrier member 46 and against the outer barrier member 44. The inner peripheral edge 46B of the inner barrier member 46 projects above the surface C so as to provide a break between the two beds.

Figure 4:
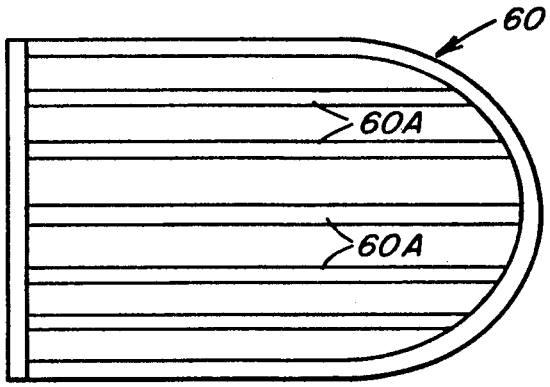
FIG. 4 is an enlarged plan view of a separator grate of the centrifugal impactor as seen along line 4—4 of FIG. 2.

Referring again to FIGS. 1, 2 and 4, the centrifugal impactor 10 of the present invention also includes a separation and bypass arrangement 58 which includes a separator 60 and a hopper 62. The separator 60 of the arrangement 58 takes the form of a grate 60 having a plurality of generally parallel-extending and spaced-apart bars 60A which define a certain grade-size. The separator grate 60 is disposed in a stationary slanted or inclined position with respect to the vertical axis A and located above the upper inlet opening 34 of the housing 12. The inclined separator grate 60 receives an incoming flow of rocks R, from a suitable source, such as an input conveyor (not shown) having a discharge end positioned adjacent the upper end of the grate 60. The inclined separator grate 60 separates the rocks into a first stream $S_1$ of rocks R larger than a grade-size defined by the separator grate 60 which will tumble down the grate 60 and fall clear of a lower end thereof, and a second stream $S_2$ of rocks R smaller than grade-size which pass through the grate 60.

The hopper 62 of the arrangement 58 has an upper portion 64 mounted to the upper horizontal wall 30 of the housing 12 and extending above and about the upper inlet opening 34 thereof, and a lower portion 66 fixedly mounted to the upper portion 64 and extending downwardly through the upper inlet opening 34 of the housing 12. The upper and lower portions 64, 66 of the hopper 62 support the separator grate 60 in the aforementioned inclined or slanted orientation. The upper portion 64 of the hopper 62, being formed by interconnected inclined walls 68, is adapted to confine and guide the first stream $S_1$ of larger than grade-size rocks R from the separator 60 toward the crushing chamber 14. The lower portion 66 of the hopper 62, being formed by interconnected vertical and horizontal walls 70. 72, is adapted to confine and guide the second stream $S_2$ of smaller than grade-size rocks R from the separator 60 toward the center of the rotor 18.

The upper and lower portions 64, 66 of the hopper 62, in effect, divides the upper inlet opening 34 in the housing 12 into an outer annular portion 34A and a central portion 34B. The first stream $S_1$ of larger than grade-size rocks R are guided, by the grate 60 and the one part of the upper hopper portion 64 located above the grate 60, through the outer annular portion 34A of upper inlet opening 34 toward the peripheral crushing chamber 14 in the housing 12, whereas the second stream $S_2$ of smaller than grade-size rocks R are guided, by the lower hopper portion 66 and the remainder of the upper hopper portion 64 located below the grate 60, through the central portion 34B of the upper inlet opening 34.

Referring still to FIGS. 1 and 2, the centrifugal impactor 10 further includes a replaceable annular wear collar 74. The wear collar 74 is supported by a plurality of bracket arms 76 removably attached at outer ends to the annular inner vertical wall 26 of the housing 12. The bracket arms 76 extend from the inner vertical wall 26 in circumferentially spaced relation to one another about the vertical axis A and in radial relation thereto. The bracket arms 76 extend across the passage 40 between the crushing chamber 14 and rotor 18 to where they support the annular wear collar 74 at their inner ends. Thus, the annular collar 74 is supported from the housing 12 in a stationary position in the annular passage 40 between the rotor 18 and the crushing chamber 14 and adjacent to and around the outer annular vertical barrier member 44 of the rotor 18 so as to shield the outer vertical barrier member 44, and the fasteners 54 attaching the wear ring 50 thereto, from impacts by rocks R passing through the passage 40.

Figure 5:
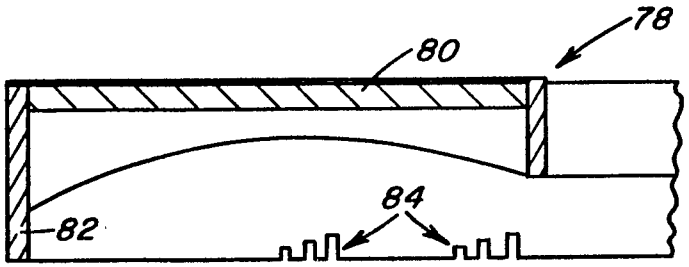
FIG. 5 is an enlarged fragmentary view of an adjustable cover of the centrifugal impactor as shown in FIG. 2.

Referring to FIGS. 1, 2 and 5, the centrifugal impactor 10 still further includes a replaceable annular cover 78 being adjustably supported below the upper horizontal wall 30 of the housing 12 above the crushing chamber 14 for vertical movement toward and away from the crushing chamber 14. The cover 78 includes a top annular wear plate 80 and an annular sidewall 82 attached to and depending from an outer peripheral edge of the top wear plate 80. The sidewa11 82 has sets of notches 84 of differing depths formed therein which can be interfitted with a plurality of vertical gussets 86 attached and extending between the outer and inner vertical walls 24, 26 of the housing 12. The gussets 86 are spaced from one another circumferentially about the crushing chamber 14 and extend radially relative to the vertical axis A of the impactor 10. The annular cover 78 can be moved to set its top plate 80 at different elevations relative to the crushing chamber 14 so as to vary the size of the crushing chamber 14 and thus vary the period of time rocks R can remain in the crushing chamber 14 and thereby vary the gradation of rocks R crushed in the impactor 10.

Lastly, referring again to FIGS. 1 and 2, the drive means 20 of the centrifugal impactor 10 for rotatably driving the rotor 18 preferably includes a right-angle gearbox 88 having the vertical drive shaft 22 and mounted to the skirt 36 of the housing 12 by braces 90 extending radially therebetween and across the lower outlet opening 38 of the housing 12. The gearbox 88 can be coupled to a suitable engine or motor (not shown), such as a diesel engine, whereby product gradation can be controlled by the rotor speed through simply varying the speed by throttel control of the diesel engine.

In operation, rocks R delivered into the upper portion 64 of the hopper 62 strike the separator grate 60 where they are separated into the two streams $S_1$, $S_2$ and either tumble down the grate 60 by-passing the rotor 18 or fall through grate 60 to the lower portion 66 of the hopper 62 where some of the rocks R are held by the horizontal wall 72 thereof so that they pile against the vertical wall 70 thereof and protect the hopper.

Additional rocks R tumble through the central portion 34A of the upper inlet opening 34 of the housing 12 and onto the center of the horizontal platform 42 of the rotor 18. The rapidly rotating rotor 18 impels rocks R toward the periphery thereof. The inner and outer vertical barrier members 46, 44 impede the rocks and cause the annular beds $B_1$, $B_2$ to build up on and rotate with the platform 42. Additional rocks tumble over the beds as they are centrifugally impelled over the upper edges of the barrier members 46, 44 and from the rotor 18. The smaller grade-size high-velocity impelled rocks impact with larger grade-size rocks which by-passed the grate 60 so as to further break and crush the rocks in both streams as they collide with one another. Rocks larger than grade-size and also rocks coming from the collisions are caught in the crushing chamber 14 to form a protective bed on the lower horizontal wall 28 thereof, or drop free through the lower outlet opening 38 of the housing 12.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A centrifugal impactor for crushing rocks, comprising:

(a) a hollow housing defining a peripheral annular crushing chamber for receiving and holding rocks and a central cavity encompassed by said crushing chamber, said housing having an upper inlet opening above said crushing chamber and said central cavity for entry of rocks into said housing and a lower outlet opening below said crushing chamber and said central cavity for discharge of rocks from said housing; and (b) a rotor mounted within said central cavity for rotation relative to said housing about a generally vertical axis and being spaced radially inwardly from said crushing chamber relative to said vertical axis so as to define an annular passage between said rotor and said crushing chamber for communicating flow of rocks from said upper housing inlet opening and said crushing chamber to said lower housing outlet opening, said rotor having a horizontal platform and a pair of outer and inner annular barrier members, said outer barrier member being disposed about a peripheral edge of said horizontal platform, said inner barrier member being disposed in concentric relation with said outer barrier member about said rotational axis of said rotor and having a terminal peripheral edge spaced radially inwardly from said outer barrier member and outwardly from said rotational axis, said inner barrier member extending a shorter distance above said horizontal platform than said outer barrier member such that said inner and outer barrier members cooperate to trap and accumulate rocks and form a pair of separate annular beds of accumulated rocks in a substantially symmetrical distribution on said horizontal platform of said rotor which rotate with said rotor and produce an improved internal balance of said rotor and a substantially uniform centrifugal discharge of rocks from said rotor over said inner and outer barrier members thereof over said annular passage toward said crushing chamber.

2. The impactor of claim 1 wherein said outer and inner barrier members are cylindrical in shape, spaced radially from one another relative to said rotational axis of said rotor, and are attached to and extend upwardly from said horizontal platform.

3. The impactor of claim 1 wherein:

said outer barrier member is cylindrical in shape and is attached to and extends upwardly from said peripheral edge of said horizontal platform; and said inner barrier member is a planar ring attached at an outer peripheral edge to said outer barrier member, is spaced above said horizontal platform, and extends radially inwardly in a cantilevered fashion from said outer barrier member to said terminal inner peripheral edge of said inner barrier member.

4. A centrifugal impactor for crushing rocks, comprising:

(a) a hollow housing defining a peripheral annular crushing chamber for receiving and holding rocks and a central cavity encompassed by said crushing chamber, said housing having an upper inlet opening above said crushing chamber and said central cavity for entry of rocks into said housing and a lower outlet opening below said crushing chamber and said central cavity for discharge of rocks from said housing; and (b) a rotor mounted within said central cavity for rotation relative to said housing about a generally vertical axis and being spaced radially inwardly from said crushing chamber relative to said vertical axis so as to define an annular passage between said rotor and said crushing chamber for communicating flow of rocks from said upper housing inlet opening and said crushing chamber to said lower housing outlet opening, said rotor having a horizontal platform and a pair of outer and inner annular vertical barrier members attached to and extending upwardly from said horizontal platform, said outer vertical barrier member being disposed about a peripheral edge of said horizontal platform, said inner vertical barrier member being disposed in concentric relation with said outer vertical barrier member about said rotational axis of said rotor and spaced radially inwardly from said outer vertical barrier member and outwardly from said rotational axis, said inner vertical barrier member extending a shorter distance above said horizontal platform than said outer vertical barrier member such that said inner and outer vertical barrier members cooperate to trap and accumulate rocks and form a pair of separate concentric annular beds of accumulated rocks in a substantially symmetrical distribution on said horizontal platform of said rotor which rotate with said rotor and produce an improved internal balance of said rotor and a substantially uniform centrifugal discharge of rocks from said rotor over said inner and outer barrier members thereof over said annular passage toward said crushing chamber.

5. The impactor of claim 4, further comprising:

a pair of wear rings attached to respective upper edges of said outer and inner vertical barrier members to protect them from contact with rocks passing over said respective barrier members.

6. The impactor of claim 4, further comprising:

a hopper mounted to said housing and extending above and about said upper inlet opening thereof and being adapted to receive an incoming flow of rocks and guide the rocks downwardly through said upper inlet opening toward said crushing chamber and said central cavity of said housing.

7. The impactor of claim 4 further comprising:

a separator disposed above said upper inlet opening thereof and being adapted to receive an incoming flow of rocks and separate the rocks into a first stream of rocks larger than a grade-size defined by said separator and a second stream of rocks smaller than grade-size.

8. The impactor of claim 7 wherein said separator is a grate disposed at an inclined relation to said vertical axis of said rotor, said grate including a plurality of generally parallel-extending and spaced-apart bars which define a certain grade-size of rock.

9. The impactor of claim 7 further comprising:

a hopper having an upper portion mounted to said housing and extending above and about said upper inlet opening thereof, said hopper also having a lower portion mounted to said upper portion and extending downwardly through said upper inlet opening of said housing, said upper and lower portions of said hopper supporting said separator and being adapted to guide said the first stream of larger than grade-size rocks from said separator toward said crushing chamber and being adapted to guide said second stream of smaller than grade-size rocks from said separator toward said rotor.

10. The impactor of claim 4 further comprising:

an annular wear collar supported by said housing in a stationary position in said annular passage between said rotor and said crushing chamber and adjacent to and around said outer vertical barrier member of said rotor to shield said outer vertical barrier member from impacts by rocks passing through said passage.

11. The impactor of claim 4 further comprising:

an annular wear cover being adjustable supported on said housing above said crushing chamber for vertical movement toward and away from said crushing chamber to vary the size of said crushing chamber and thus the period of time rocks can remain in said crushing chamber and thereby the gradation of rocks crushed in said impactor.

12. The impactor of claim 11 wherein said wear cover includes notches of different depths defined on a lower edge thereof for adjusting the position of said cover relative to said crushing chamber.

13. The impactor of claim 4 further comprising:

drive means mounted to said housing and disposed below said rotor and having a rotatable vertical drive shaft mounting said rotor at an upper end of said shaft for rotating said rotor with said shaft.

14. The impactor of claim 13 wherein said drive means includes a right-angle gearbox having said vertical drive shaft.

15. A centrifugal impactor for crushing rocks, comprising:

(a) a hollow housing defining a peripheral annular crushing chamber for receiving and holding rocks and a central cavity encompassed by said crushing chamber, said housing having an upper inlet opening above said crushing chamber and said central cavity for entry of rocks into said housing and a lower outlet opening below said crushing chamber and said central cavity for discharge of rocks from said housing; and (b) a rotor mounted within said central cavity for rotation relative to said housing about a generally vertical axis and being spaced radially inwardly from said crushing chamber relative to said vertical axis so as to define an annular passage between said rotor and said crushing chamber for communicating flow of rocks from said upper housing inlet opening and said crushing chamber to said lower housing outlet opening, said rotor having means for cooperating to trap and accumulate rocks and form a pair of separate annular beds of accumulated rocks on said rotor which rotate with said rotor and produce a centrifugal discharge of rocks from said rotor over said passage toward said crushing chamber; and (c) a separation and bypass arrangement including a separator adapted to receive an incoming flow of rocks and separate the rocks into a first stream of rocks larger than a grade-size defined by said separator and a second stream of rocks smaller than grade-size, said arrangement also including a hopper extending above said housing and encompassing said upper inlet opening thereof, said hopper also extending downwardly through said upper inlet opening of said housing and being adapted to guide said the first stream of larger than grade-size rocks through said housing inlet opening toward said outer annular crushing chamber of said housing and to guide said second stream of smaller than grade-size rocks through said housing inlet opening toward said rotor.

16. The impactor of claim 15 wherein said separator is a grate disposed at an inclined relation to said vertical axis of said rotor, said grate including a plurality of generally parallel-extending and spaced-apart bars which define a certain grade-size of rock.

17. The impactor of claim 15 wherein said hopper includes:

an upper portion mounted to said housing and extending above and about said upper inlet opening thereof; and a lower portion mounted to said upper portion and extending downwardly through said upper inlet opening of said housing, said upper and lower portions of said hopper supporting said separator and being adapted to guide said the first stream of larger than grade-size rocks from said separator toward said crushing chamber and being adapted to guide said second stream of smaller than grade-size rocks from said separator toward said rotor.

18. The impactor of claim 15 further comprising:

an annular wear collar supported by said housing in a stationary position in said annular passage between said rotor and said crushing chamber and adjacent to and around the periphery of said rotor to shield said rotor from impacts by rocks passing through said passage.

19. The impactor of claim 15 further comprising:

an annular wear cover being adjustable supported on said housing above said crushing chamber for vertical movement toward and away from said crushing chamber to vary the size of said crushing chamber and thus the period of time rocks can remain in said crushing chamber and thereby the qradation of rocks crushed in said impactor.

20. The impactor of claim 15 further comprising:

drive means mounted to said housing and disposed below said rotor and having a rotatable vertical drive shaft mounting said rotor at an upper end of said shaft for rotating said rotor with said shaft.

* * * * *